US006435700B1

(12) United States Patent
Graham

(10) Patent No.: US 6,435,700 B1
(45) Date of Patent: Aug. 20, 2002

(54) ADJUSTABLE LAMP SHADE

(76) Inventor: Michael Graham, 2263 Sea Air Ave., Rehoboth, DE (US) 19971

( * ) Notice: Subject to any disclaimer, the term of this patent is extended or adjusted under 35 U.S.C. 154(b) by 0 days.

(21) Appl. No.: 09/643,690

(22) Filed: Aug. 22, 2000

(51) Int. Cl.[7] ..... F21V 1/08; F21V 17/02
(52) U.S. Cl. ..... 362/360; 362/283; 362/449
(58) Field of Search ..... 362/18, 283, 351, 362/352, 358, 360, 367, 449, 450

(56) References Cited

U.S. PATENT DOCUMENTS 452,638 A * 5/1891 Gartner et al. ..... 362/360
4,446,506 A * 5/1984 Larson ..... 362/449
4,656,568 A * 4/1987 Reed ..... 362/352
4,731,716 A * 3/1988 Chang ..... 362/352
4,777,566 A * 10/1988 Lowell et al. ..... 362/18
5,347,432 A * 9/1994 Chiavetta ..... 362/18
5,532,912 A * 7/1996 Bendit ..... 362/352

* cited by examiner

*Primary Examiner*—Alan Cariaso

(57) ABSTRACT

An adjustable lamp shade for use in association with a table lamp with a threaded upper bolt and a light source, the apparatus comprises a center support formed of a plurality of rods, a cross plate with a centrally positioned aperture being coupled to the center support; and a shade frame formed of a plurality of panels, each panel having an upper shaft including a plurality of clips, the shade frame being coupled to the rods of the center support center support by the clips, the clips allowing a user to swivel each panel of the shade frame independently of the other panels, in an operative orientation a user raising a single panel of the shade frame in order to direct light in a specific direction.

10 Claims, 4 Drawing Sheets

ADJUSTABLE LAMP SHADE

BACKGROUND OF THE INVENTION

1. Field of the Invention

The present invention relates to an adjustable lamp shade and more particularly pertains to directing light by adjusting one or more panels of the apparatus.

2. Description of the Prior Art

The use of lamp shades is known in the prior art. More specifically, lamp shades heretofore devised and utilized for the purpose of covering lamps are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,115,385 to Jeckle discloses a shaped lamp shade.

U.S. Pat. No. 4,120,027 to Stark discloses a collapsible lamp shade having interchangeable configurations.

U.S. Pat. No. Des. 339,653 to Porter discloses a lamp shade.

U.S. Pat. No. 5,195,714 to Stewart discloses a bookholder with adjustable shade.

U.S. Pat. No. Des. 252,593 to Hilsdale discloses a lamp shade.

While these devices fulfill their respective, particular objective and requirements, the aforementioned patents do not describe an adjustable lamp shade for directing light by adjusting one or more panels of the apparatus.

In this respect, the adjustable lamp shade according to the present invention substantially departs from the conventional concepts and designs of the prior art, and in doing so provides an apparatus primarily developed for the purpose of directing light by adjusting one or more panels of the apparatus.

Therefore, it can be appreciated that there exists a continuing need for new and improved adjustable lamp shade which can be used for directing light by adjusting one or more panels of the apparatus. In this regard, the present invention substantially fulfills this need.

SUMMARY OF THE INVENTION

In the view of the foregoing disadvantages inherent in the known types of lamp shades now present in the prior art, the present invention provides an improved adjustable lamp shade. As such, the general purpose of the present invention, which will be described subsequently in greater detail, is to provide a new and improved adjustable lamp shade and method which has all the advantages of the prior art and none of the disadvantages.

To attain this, the present invention essentially comprises a new and improved adjustable lamp shade for use in association with a table lamp having a threaded upper bolt and a light source, the apparatus comprising, in combination: a center support formed of four metal rods arranged in a generally rectangular configuration, the approximate center point of each rod including three indents positioned one above the other, the center support including a cross plate coupled to two opposing rods of the center support, the cross plate including a centrally positioned aperture; a shade frame including a front panel, a rear panel and two side panels, each panel being formed in a generally trapezoidal configuration with a short upper shaft, a long lower shaft and two side shafts, the upper and lower shafts being positioned parallel with respect to each other, each upper shaft including a detent extending therefrom, each upper shaft including a long cylindrical central clip, the upper shafts of the front and rear panels further including two short cylindrical side clips, the central clip of each panel being coupled to a rod of the center support adjacent the indents, the detent of the upper shaft of each panel adapted to be coupled within an indent of a rod, this configuration enabling a user to swivel a panel to one of three positions independently of the other panels, in an operative orientation a user raising one or more panels of the shade frame in order to direct light in a specific direction, in an inoperative orientation the front and rear panels resting upon the side panels in an overlapping configuration; a plurality of shade cover sets, each set comprising four shade covers, each cover being affixed around the rods of a panel of the shade frame; and a filial fabricated of glass and formed in a generally cone shaped configuration with a patterned exterior surface and a threaded interior, the shade frame and center support being positioned over a table lamp with the central aperture of the cross plate being positioned around the threaded upper bolt, the filial being coupled to the threaded upper bolt, the filial securing the shade frame to the lamp.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved adjustable lamp shade which has all the advantages of the prior art lamp shades and none of the disadvantages.

It is another object of the present invention to provide a new and improved adjustable lamp shade which may be easily and efficiently manufactured and marketed.

It is a further object of the present invention to provide a new and improved adjustable lamp shade which is of durable and reliable construction.

An even further object of the present invention is to provide a new and improved adjustable lamp shade which is susceptible of a low cost of manufacture with regard to both materials and labor, and which accordingly is then susceptible of low prices of sale to the consuming public, thereby making such an adjustable lamp shade economically available to the buying public.

Still yet another object of the present invention is to provide a new and improved adjustable lamp shade which provides in the apparatuses and methods of the prior art some of the advantages thereof, while simultaneously overcoming some of the disadvantages normally associated therewith.

Even still another object of the present invention is to provide a new and improved adjustable lamp shade for directing light by adjusting one or more panels of the apparatus.

Lastly, it is an object of the present invention to provide a new and improved adjustable lamp shade for use in association with a table lamp with a threaded upper bolt and a light source, the apparatus comprises a center support formed of a plurality of rods, a cross plate with a centrally positioned aperture being coupled to the center support; and a shade frame formed of a plurality of panels, each panel having an upper shaft including a plurality of clips, the shade frame being coupled to the rods of the center support center support by the clips, the clips allowing a user to swivel each panel of the shade frame independently of the other panels, in an operative orientation a user raising a single panel of the shade frame in order to direct light in a specific direction.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
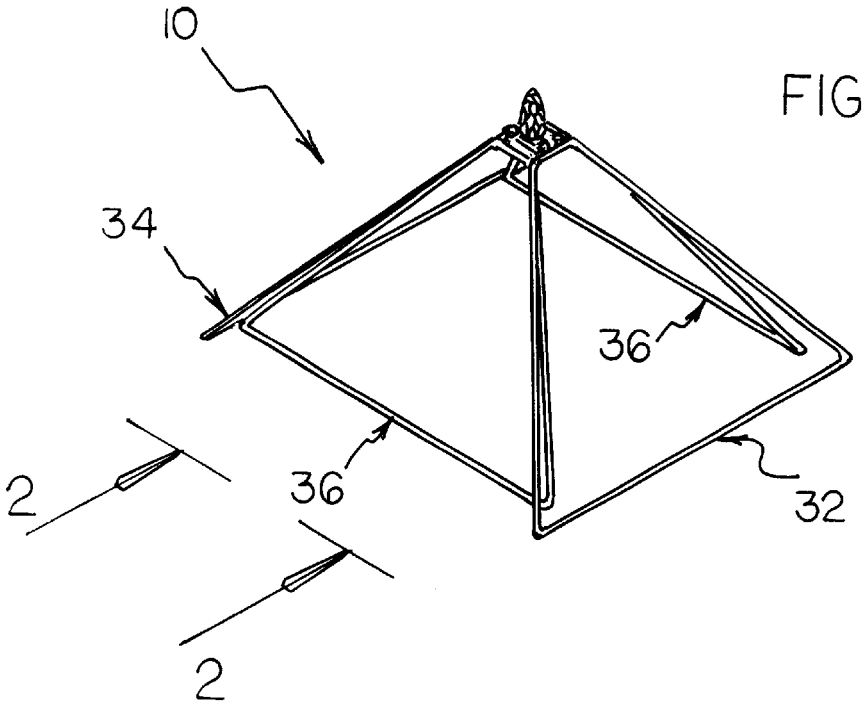
FIG. 1 is a perspective view of the preferred embodiment of the adjustable lamp shade constructed in accordance with the principles of the present invention.

With reference now to the drawings, and in particular, to FIG. 1 thereof, the preferred embodiment of the new and improved adjustable lamp shade embodying the principles and concepts of the present invention and generally designated by the reference number 10 will be described.

Specifically, it will be noted.in the various Figures that the device relates to an adjustable lamp shade 10 for directing light by pivoting. one or more panels of the apparatus. In its broadest context, the device consists of a center support 12, a shade frame 14, fabric shade covers 16 and a filial 18. Such components are individually configured and correlated with respect to each other so as to attain the desired objective.

The adjustable lamp shade 10 is adapted for use in association with a conventional table lamp having a threaded upper bolt 20 and a light source 22. Most table lamps include one or more arched support members 24 which extend above the light source. The light source utilized is generally a light bulb. Note FIG. 1.

The center support 12 is formed of four metal rods 26 arranged in a generally rectangular configuration. Each rod has a length of one inch. The approximate center point of each rod includes three generally semicylindrical indents 28 positioned one above the other. A cross plate 30 is coupled to two opposing rods of the center support. The cross plate includes a centrally positioned aperture. The aperture is positioned around the upper bolt 20 of the table lamp in an operative orientation. Note FIGS. 2 and 3.

A shade frame 14 includes a front panel 32, a rear panel 34 and two side panels 36. Each panel is formed in a generally trapezoidal configuration including a short upper shaft 38, a long lower shaft 40 and two side shafts 42. The length of each lower shaft is eighteen inches. The upper and lower shafts are positioned parallel with respect to each other. The side shafts are positioned in an inwardly angled orientation from bottom to top. Note FIG. 1.

Figure 4:
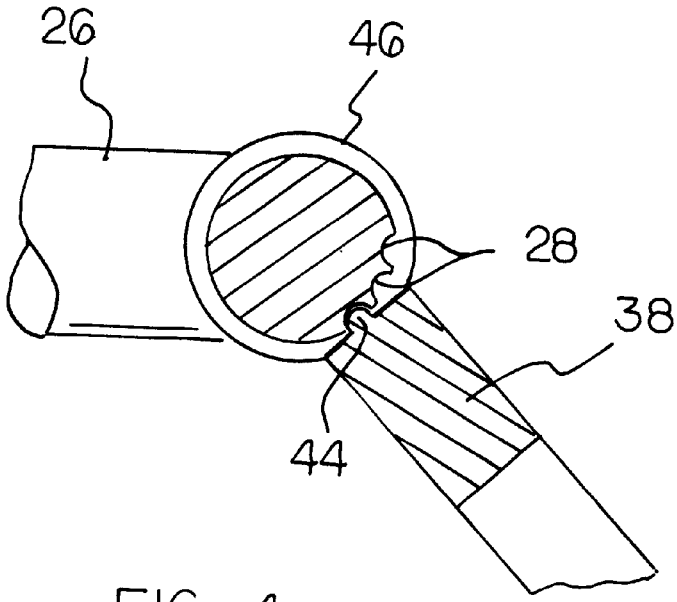
FIG. 4 discloses a cross sectional view taken along section line 4—4 of FIG. 3.

Each upper shaft includes a detent 44 extending from it. Each upper shaft also includes a long cylindrical central clip 46. The upper shafts of the front and rear panels further include two short cylindrical side clips 48. The central clip of each panel is coupled to a rod of the center support adjacent to the indents. The plane of each panel is angled outwardly from upper shaft to the lower shaft in the assembled orientation. The height of the shade frame is seven inches. The detent of the upper shaft of each panel is adapted to be coupled within an indent of a rod. This configuration enables a user to swivel a panel to one of three positions independently of the other panels. Note FIGS. 1 and 4.

Figure 5:
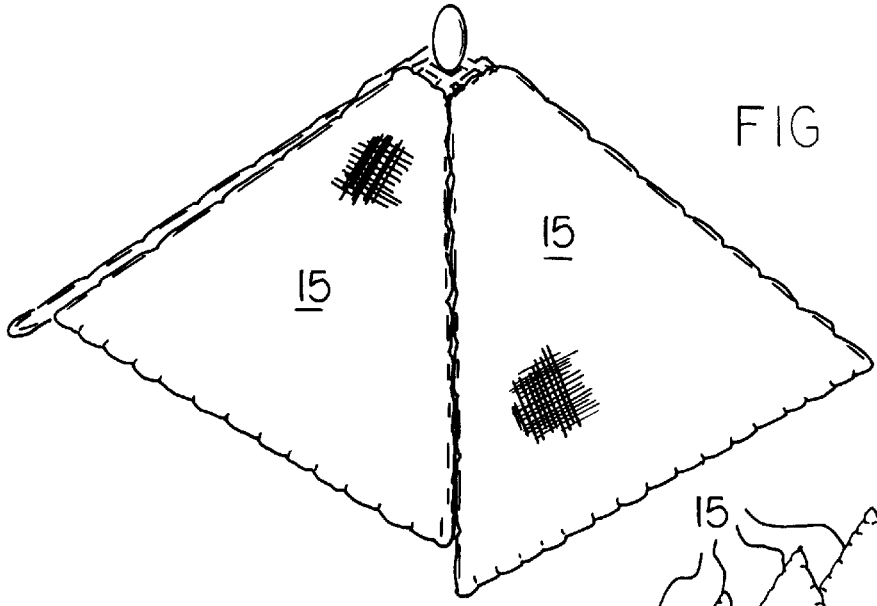
FIGS. 5, 5*a* and 6 disclose the configuration and positioning of the cloth shade covers upon the shade frame of the apparatus.
Figure 5A:
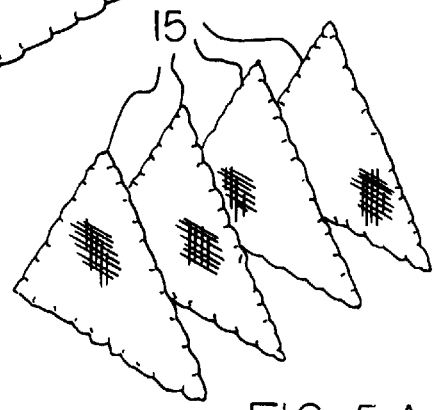
Figure 6:
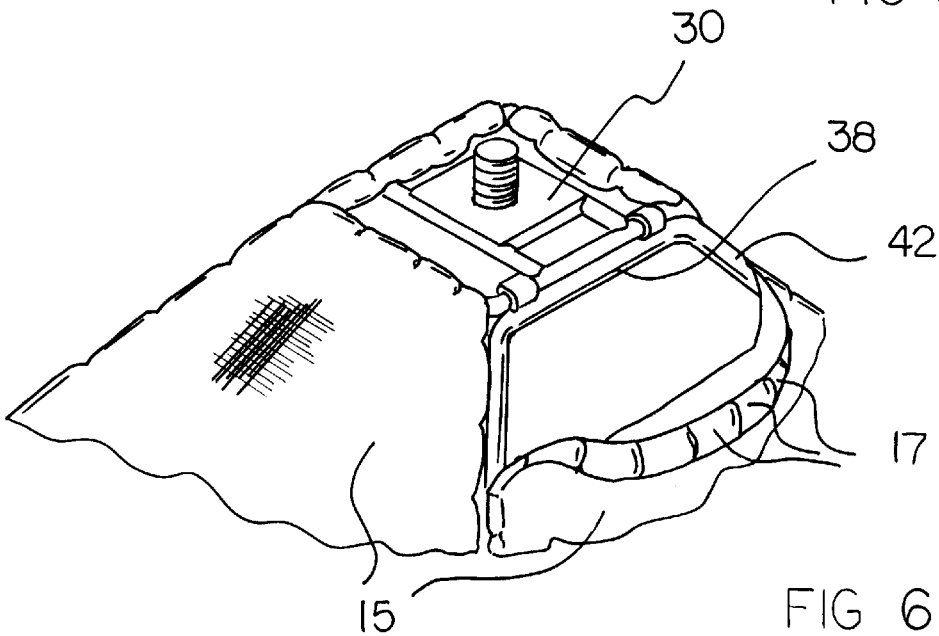

A plurality of shade cover sets are utilized in the preferred embodiment of the apparatus. The shade cover sets are fabricated in various colors. Each shade cover set includes four shade covers 15. The shade covers 15 are fabricated of cloth material and include elastomeric bands 17 to permit removable coupling around a panel of the shade frame. This enables a user to match the shade frame to the decor of a particular room. In an operative orientation a user raises one or more panels of the shade frame in order to direct light in a specific direction. This allows a user to quickly and effectively increase or decrease the lighting conditions in various parts of a room. Note FIGS. 5, 5*a* and 6.

Figure 2:
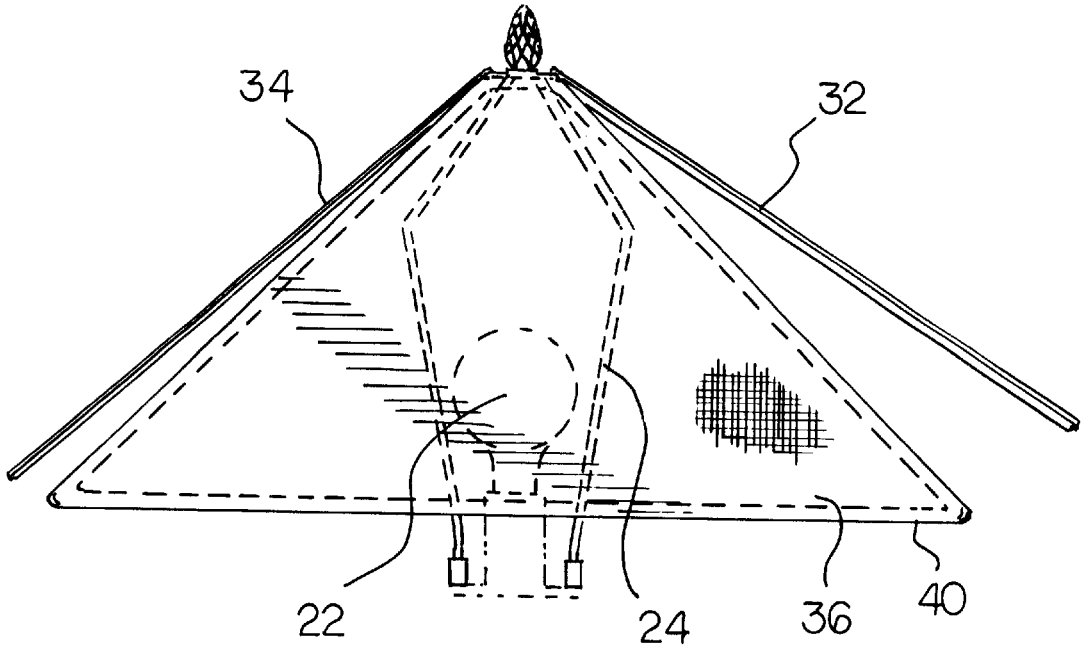
FIG. 2 discloses a side perspective view of the apparatus.
Figure 3:
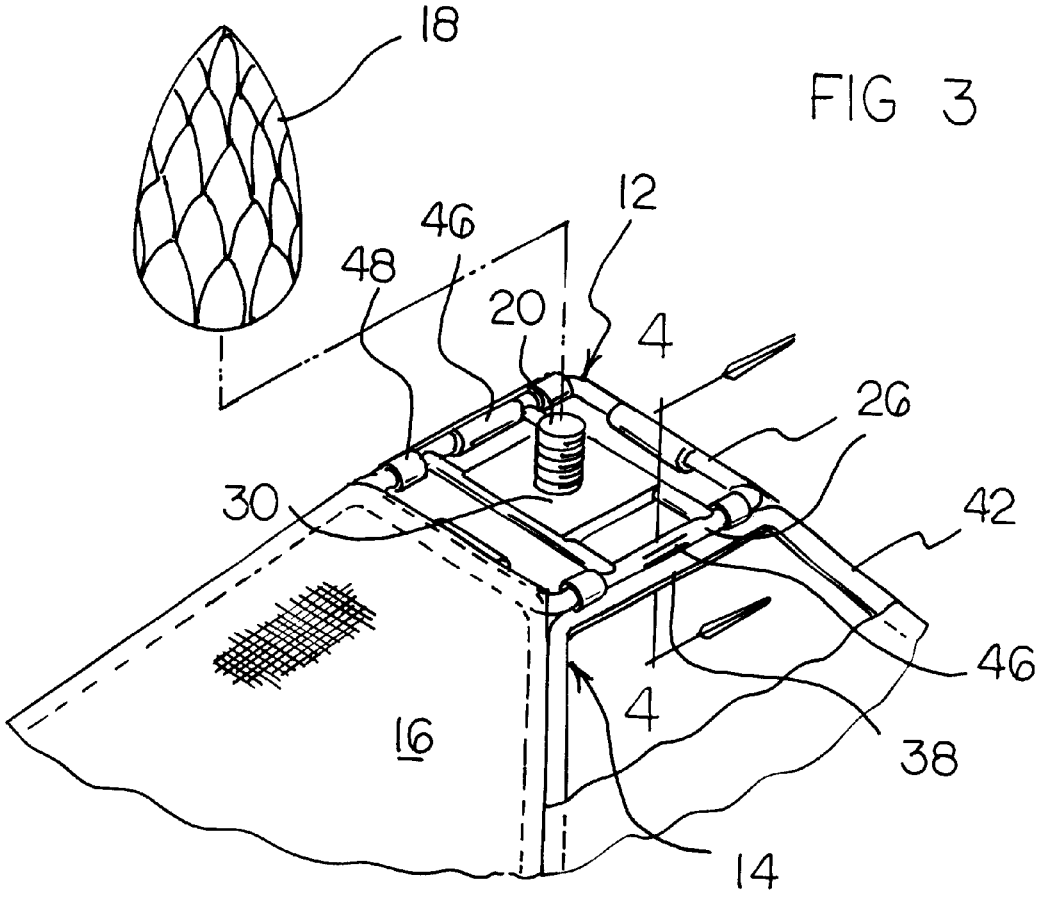
FIG. 3 discloses a top perspective view of the apparatus.
Figure 7:
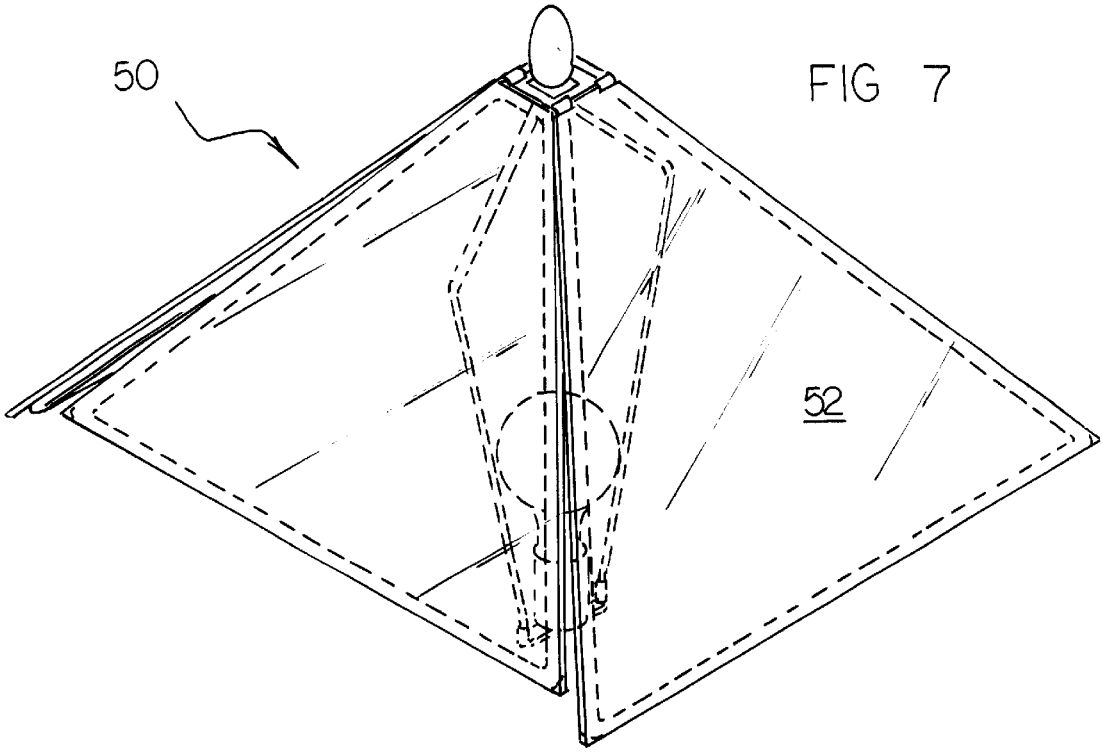
FIG. 7 is an alternative embodiment of the apparatus disclosing transparent glass shade covers affixed to the panels of the shade frame.
Figure 8:
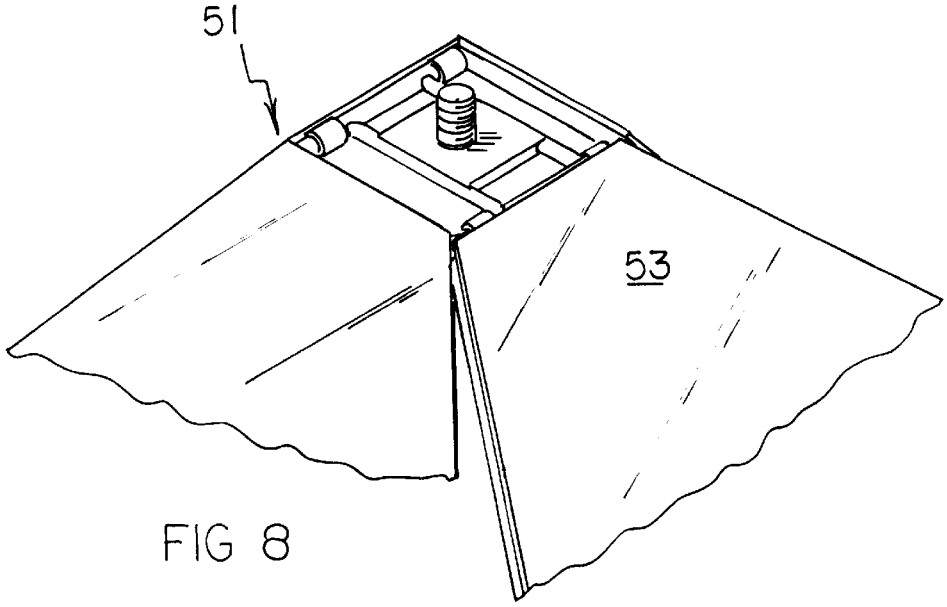
FIG. 8 is an alternative embodiment of the apparatus disclosing rigid opaque shade covers affixed to the panels of the shade frame.

An alternate embodiment of the apparatus is shown in FIGS. 2 and 3. In such embodiment all of the components of the apparatus are the same as those of the preferred embodiment except that the shade covers are fabricated of fabric 16 and sewn around the rods of the panels of the shade frame. The fabric is made of a pillow case type material. In a further alternate embodiment of the apparatus transparent glass 52 is utilized in place of the shade covers. Such embodiment 50 is disclosed in FIG. 7. Another alternative embodiment 51 is disclosed in FIG. 8. In such embodiment rigid, opaque material such as glass or ceramic are utilized.

A filial 18 is fabricated of glass and formed in a generally cone shaped configuration with a patterned exterior surface and a threaded interior. In an operative orientation the shade frame and center support are positioned over a table lamp with the central aperture of the cross plate positioned around the threaded upper bolt. The filial is coupled to the threaded upper bolt to secure the apparatus in place around the table lamp. In the preferred embodiment the exterior surface of the filial has a jeweled pattern. Note FIG. 3.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An adjustable lamp shade for use in association with a table lamp having a threaded upper bolt and a light source, the apparatus comprising, in combination:

a center support formed of four metal rods arranged in a generally rectangular configuration, the approximate center point of each rod including three indents positioned one above the other, the center support including a cross plate coupled to two opposing rods of the center support, the cross plate including a centrally positioned aperture;

a shade frame including a front panel, a rear panel and two side panels, each panel being formed in a generally trapezoidal configuration with a short upper shaft, a long lower shaft and two side shafts, the upper and lower shafts being positioned parallel with respect to each other, each upper shaft including a detent extending therefrom, each upper shaft including a cylindrical central slip, the upper shafts of the front and rear panels further including two short cylindrical side clips, the central clip of each panel being coupled to a rod of the center support adjacent the indents, and detent of the upper shaft of each panel adapted to be coupled within an indent of a rod, this configuration enabling a user to swivel a panel to one of three positions independently of the other panels, in an operative orientation a user raising one or more panels of the shade frame in order to direct light in a specific direction, in an inoperative orientation the front and rear panels resting upon the side panels in an overlapping configuration;

a plurality of shade cover sets, each set comprising four shade covers, each cover being affixed around the rods of a panel of the shade frame; and a finial fabricated of glass and formed in a generally cone shaped configuration with a patterned exterior surface and a threaded interior, the shade frame and center support being positioned over a table lamp with the central aperture of the cross plate being positioned around the threaded upper bolt, the finial being coupled to the threaded upper bolt, the finial securing the shade frame to the lamp.

2. An adjustable lamp shade for use in association with a table lamp with a threaded upper bolt and a light source, that apparatus comprising:

a center support formed of a plurality of rods, a cross plate with a centrally positioned aperture being coupled to the center support;

a shade frame formed of a plurality of panels, each panel having an upper shaft including a plurality of clips, the shade frame being coupled to the rods of the center support by the clips, the clips allowing a user to swivel each panel of the shade frame independently of the other panels, in an operative orientation a user raising a single panel of the shade frame in order to direct light in a specific direction; and a plurality of shade cover sets, each set comprising a plurality of shade covers, each shade cover being removably coupled around the rods of a panel of the shade frame.

3. The adjustable lamp shade as set forth in claim 2 wherein the rods of the center support include a plurality of indents and the upper shaft of the panels each include a semi-cylindrical detent, in an operative orientation each detent adapted to be coupled within an indent of a rod to permit independent adjustment of the panels.

4. The adjustable lamp shade as set forth in claim 2 wherein the shade covers are fabricated of cloth.

5. The adjustable lamp shade as set forth in claim 2 wherein the shade covers are fabricated of transparent glass.

6. The adjustable lamp shade as set forth in claim 2 wherein the shade covers are fabricated of rigid opaque material.

7. The adjustable lamp shade as set forth in claim 3 wherein the finial is fabricated of a clear solid jeweled material.

8. The adjustable lamp shade as set forth in claim 2 wherein the shade covers are fabricated of cloth material, each shade cover including an elastomeric band to permit removable coupling around a panel of the shade frame.

9. The adjustable lamp shade as set forth in claim 2 wherein the shade covers are fabricated of fabric and sewn around the rods of the panels of the shade frame.

10. The adjustable lamp shade as set forth in claim 2 wherein the shade covers are fabricated of fabric and sewn around the rods of the panels of the shade frame.

* * * * *